US005885372A

United States Patent [19]

Seegopaul

[11] Patent Number: 5,885,372

[45] Date of Patent: Mar. 23, 1999

[54] MULTI-STEP PROCESS TO INCORPORATE GRAIN GROWTH INHIBITORS IN WC-CO COMPOSITE

[75] Inventor: Purnesh Seegopaul, Flemington, N.J.

[73] Assignee: Nanodyne Incorporated, New Brunswick, N.J.

[21] Appl. No.: 733,233

[22] Filed: Oct. 2, 1996

[51] Int. Cl.[6] ..... C23C 8/20

[52] U.S. Cl. ..... 148/237; 148/423; 148/425

[58] Field of Search ..... 148/237, 423, 148/425; 75/236, 248, 255, 242

[56] References Cited

U.S. PATENT DOCUMENTS

| | | | |
|---|---|---|---|
| 4,234,333 | 11/1980 | Ghandehari et al. | 75/0.5 BA |
| 5,230,729 | 7/1993 | McCandlish et al. | 75/351 |
| 5,352,269 | 10/1994 | Mcandlish et al. | 75/351 |

FOREIGN PATENT DOCUMENTS

| | | |
|---|---|---|
| 4414135A1 | 6/1995 | Germany . |
| WO 96 24454 | 8/1996 | WIPO . |

OTHER PUBLICATIONS

Wu, L., *Nanostructure Tungsten Carbide/Cobalt Alloys: Processing and Properties,* Dissertation Abstracts International 54, (9) May 1993.

*Primary Examiner*—Deborah Yee
*Attorney, Agent, or Firm*—Wood. Herron & Evans, LLP

[57] ABSTRACT

Grain growth inhibitors including vanadium carbide, chromium carbide, tantalum carbide, and niobium carbide are incorporated into a cobalt/tungsten carbide matrix during the formation of the cobalt/tungsten carbide matrix. A precursor powder is formed by combining in solution a cobalt composition, a tungsten composition and a grain growth inhibiting metal composition, which is then spray dried. The precursor compound is then carburized in carbon monoxide and carbon dioxide to form cobalt/tungsten carbide matrix. This is then further carburized in a hydrocarbon hydrogen gas at an elevated temperature to cause the grain growth inhibiting metal present to form the carbide. The second carburizing step is conducted with a carburizing gas having a carbon activity greater than about 2 for a relatively short period of time at 900° C. to 1000° C.

10 Claims, No Drawings

MULTI-STEP PROCESS TO INCORPORATE GRAIN GROWTH INHIBITORS IN WC-CO COMPOSITE

BACKGROUND OF THE INVENTION

Cemented carbide articles such as cutting tools, mining tools, and wear parts are routinely manufactured from carbide powders and metal powders by the powder metallurgy techniques of liquid phase sintering or hot pressing. Cemented carbides are made by "cementing" hard tungsten carbide (WC) grains in a softer fully-dense metal matrix such as cobalt (Co) or nickel (Ni).

The requisite composite powder can be made in two ways. Traditionally, WC powder is physically mixed with Co powder in a ball mill to form composite powder in which WC particles are coated with Co metal. A newer way is to use spray conversion processing, in which composite powder particles are produced directly by chemical means. In this case, a precursor salt in which W and Co have been mixed at the atomic level, is reduced and carbonized to form the composite powder. This method produces powder particles in which many WC grains are imbedded in a cobalt matrix. Each individual powder particle with a diameter of 50 micrometers contains WC grains a thousand times smaller.

The next step in making a cemented carbide article is to form a green part. This is accomplished by pressing or extruding WC-Co powder. The pressed or extruded part is soft and full of porosity. Sometimes further shaping is needed, which can be conveniently done at this stage by machining. Once the desired shape is achieved, the green part is liquid phase sintered to produce a fully dense part. Alternatively, a fully-dense part is sometimes produced directly by hot pressing the powder. In a final manufacturing step, the part is finished to required tolerances by diamond grinding.

Cemented carbides enjoy wide applicability because the process described above allows one to control the hardness and strength of a tool or part. High hardness is needed to achieve high wear resistance. High strength is needed if the part is to be subjected to high stresses without breaking. Generally, cemented carbide grades with low binder levels possess high hardness, but have lower strength than higher binder grades. High binder levels produce stronger parts with lower hardness. Hardness and strength are also related to carbide grain size, the contiguity of the carbide grains and the binder distribution. At a given binder level, smaller grained carbide has a higher hardness. Trade-off tactics are often adopted to tailor properties to a particular application. Thus, the performance of a tool or part may be optimized by controlling amount, size and distribution of both binder and WC.

The average WC grain size in a sintered article will not, generally, be smaller than the average WC grain size in the powder from which the article was made. Usually, however, it is larger because of grain growth that takes place, primarily, during liquid phase sintering of the powder compact or extrudate. For example, one can start with 50 nanometer WC grains in a green part and end up with WC grains larger than 1 micrometer.

A major technical challenge in the art of sintering is to limit such grain growth so that finer microstructures can be attained. Thus, it is typical to add a grain growth inhibitor to WC-Co powder before it is compacted or extruded. The two most commonly used grain growth inhibitors are vanadium carbide (VC) and chromium carbide ($Cr_3C_2$) with TaC and NbC used less frequently. However, the use of these additives presents some problems. First, both are particularly oxygen sensitive, and when combined with WC and binder metal in a mill, both tend to take up oxygen, forming surface oxides. Later, during the liquid phase sintering step, these oxides react with carbon in the mixture to form carbon monoxide (CO) gas. If extra carbon has not been added to the powder to allow for this consumption of carbon, then this results in the WC and Co forming brittle η-phases, which ruins the article. If too much carbon has been added, so-called carbon porosity results, again ruining the article. Even if just the right amount of carbon has been added, the evolution of CO gas itself can lead to unacceptable levels of porosity. High oxygen levels in powder compacts or extrudates lead to major problems during their sintering.

The present invention is premised on the realization that grain growth inhibitors, including vanadium carbide, chromium carbide, niobium carbide and tantalum carbide can be incorporated into a cobalt/tungsten cobalt carbide matrix during the formation of the cobalt/tungsten cobalt carbide matrix. More specifically, the present invention is premised on the realization that suitable salts of vanadium, chromium, tantalum, niobium or mixtures thereof can be combined with cobalt and tungsten compounds, dissolved into solution, and spray dried to form precursor compounds. In turn, the precursor compounds can be carburized using a two-step process to form tungsten carbide embedded in cobalt matrix, along with the carbides of vanadium, chromium, tantalum and/or niobium, while retaining the fine grain structure in the powder.

The carburization process requires a two-step process. In the initial process a relatively low carbon activity gas formed from carbon monoxide and carbon dioxide are used at relatively low temperatures —about 750° C. to 850° C. This is continued until the tungsten is completely reacted to form tungsten carbide. This will leave the grain growth inhibitor composition as an oxide. The carburization is then continued using a gas having a higher carbon activity, specifically a combination of hydrogen and a hydrocarbon at a higher temperature, about 850° C. to 950° C., for no more than one hour. This will quickly cause the grain growth inhibiting composition to change from an oxide to a carbide without adversely affecting the previously-formed tungsten carbide/cobalt matrix. This allows the grain growth inhibitor to be directly formed with the cobalt/tungsten carbide matrix providing for more uniform distribution, less oxide formation, less oxygen sensitivity, and retention of fine grain size. This also reduces processing steps.

The objects and advantages of the present invention will be further appreciated in light of the following detailed description.

DETAILED DESCRIPTION

According to the present invention, a tungsten carbide/cobalt matrix is formed which has evenly distributed throughout a grain growth inhibiting composition which is a carbide of vanadium, chromium, niobium, tantalum and mixtures thereof. In order to form these compounds, a precursor particle is formed. The precursor particle is simply a spray-dried particle which is formed from a solution having dissolved therein a cobalt composition, a tungsten composition and a composition of one or more of vanadium, chromium, tantalum and niobium.

The process of forming the precursor particles is disclosed in McCandlish et al. U.S. Pat. No. 5,352,269. The purpose is to form a solution that contains cobalt, tungsten, as well as the grain growth inhibiting metal. This solution can be formed with any solvent, but for environmental reasons it is preferred that the solvent be water. Therefore, preferably all the compositions will be water-soluble. If, for some reason, it is desired to use a different solvent such as a hydrocarbon solvent, then water-insoluble, hydrocarbon-soluble compositions would be employed.

With respect to cobalt, the cobalt is preferably added using a precursor composition such as cobaltous chloride, cobaltous nitrate, or cobaltous acetate. Tungsten compositions that are suitable for use in the present invention would be ammonium metatungstate, tris-ethylenediamine cobalt tungstate (which provides both cobalt and tungsten), as well as tungstic acid, preferably dissolved in ammonium hydroxide.

The grain growth inhibiting compositions suitable for use in the present invention would be compositions of the metal such as acetates, carbonates, formates, citrates, hydroxides, nitrates, oxides, formates and oxylates. These are all combined in the desired proportions to form the cobalt/tungsten carbide matrix with the desired amount of grain growth inhibiting carbide. Generally, from about 0.15% to about 5% (preferably less than 3%) of the grain growth inhibiting carbide will be present in the formed composition. Generally, there will be about 2% to about 20% cobalt, with about 80% to about 97% tungsten by weight. Thus, the precursor solution is formed with these desired end ratios in mind.

The solution is then spray-dried to form homogeneous, discrete powder particles. Any type of spray drying apparatus can be employed. The goal is simply to provide small, uniform particles containing the cobalt, tungsten and grain growth inhibiting metal. This powder is then carburized in a gas mixture of carbon monoxide and carbon dioxide or hydrogen/carbon monoxide, according to the method disclosed in McCandlish U.S. Pat. No. 5,230,729. The precursor particles are introduced into a reactor and heated in the presence of a carburizing gas. Many different reactors can be used. It is best to use a reactor that provides good contact of the carburizing gas with the particles. A fluidized bed reactor as well as a rotary bed reactor can be used. Further, a fixed bed reactor can even be used, but this increases reaction time due to the decreased physical mixture of the carburizing gas.

Initially, the tungsten carbide is carburized. In this initial carburization, the carburizing gas is a combination of carbon monoxide and carbon dioxide or hydrogen/carbon monoxide, and the reaction temperature should be from about 750° C. up to about 850° C., with 775°–835° C. preferred. Initially the carbon activity of the gas is established at >1, preferably from about 1 to about 1.4, with about 1.2 being preferred. The carbon activity of the gas is adjusted by altering the ratio of carbon monoxide to carbon dioxide or carbon monoxide levels in hydrogen/carbon monoxide. This is continued for a period of about 2 hours, and then the carbon activity is reduced to below 1, preferably less than 0.5, preferably around 0.3. When the carbon activity is greater than 1, free carbon is deposited. Establishing the carbon activity at less than 1 will then drive off this free carbon. The reduced carbon activity reaction is continued for up to about 25 hours, and then the higher carbon activity reaction is resumed. This is cycled back and forth 4 to 7 times until the reaction is complete.

After the formation of the tungsten carbide is complete, the reaction conditions are modified to cause the grain growth inhibiting metal to form a carbide. In order to form the grain growth inhibiting carbide, the carburization gas is changed and the temperature is changed. The second carburization gas must have a high carbon activity greater than 1.3, and preferably at least about 3.0. Further, the carburizing gas cannot contain oxygen. Accordingly, the carburizing gas is formed preferably from a hydrocarbon, in combination with hydrogen as a diluent. The hydrocarbon can be, for example, methane, ethane, propane, natural gas, ethylene, propylene, acetylene and the like, as long as it contains only hydrogen and carbon and no oxygen. The reaction temperature needs to be somewhat higher, preferably from about 900° C. to 1000° C. This is continued for a relatively short period of time, preferably as brief as possible. The time will preferably be about less than 1 hour, depending upon the amount of grain growth inhibiting metal present. Typically, there will be from about 0.15% up to no more than 5% of the grain growth inhibiting metal. Therefore the conversion time is very rapid. After the second conversion step is complete, the product is then allowed to cool and can be subsequently processed into tungsten carbide tools and the like.

The present invention will be further appreciated in light of the following detailed examples.

EXAMPLE 1

Ten pounds of spray dried W—Co—Cr—V salts (WC-10% Co-0.3% VC-0.31 % $Cr_3C_2$) are loaded into the tube furnace. Under nitrogen, the powder is heated to 850° C. and carburized with hydrogen/30% carbon monoxide. Excess free carbon is removed by adding 12% carbon dioxide to the gases (4 minutes for each hour). After 16 hours, the temperature is raised to 900° C. and a gas mixture of hydrogen (10%) methane is applied for 1 hour. Cooling is then done under nitrogen. This results in the formation of WC—Co—VC—$Cr_3C_2$. The grain growth inhibitors are evenly distributed throughout the matrix.

Thus the present invention provides a method of incorporating grain growth inhibitors into a tungsten carbide/cobalt matrix, which in turn permits these products to be further sintered and processed while grain growth is minimized. The processing steps of the present invention allow the grain growth inhibitor to be uniformly dispersed throughout the product and further minimizes the oxygen sensitivity or overall effect of oxygen on the formed product.

This has been a description of the present invention, along with a preferred method of practicing the present invention. However, the invention itself should only be defined by the appended claims wherein we claim:

1. A method of forming cobalt/tungsten carbide particles containing a carbide of a grain growth inhibiting metal selected from the group consisting of vanadium, chromium, tantalum and niobium from a precursor powder containing cobalt, tungsten and at least one of said grain growth inhibiting metals comprising subjecting said precursor powder to an initial carburization with a carburizing gas comprising a mixture of carbon monoxide and carbon dioxide at a temperature effective to form tungsten carbide; and a second carburization step using a carburizing gas comprising a diluent and a hydrocarbon gas having a carbon activity greater than about 1.4 at a temperature of about 900° C. to 1000° C.

2. The method claimed in claim 1 wherein said initial carburization is conducted at a temperature of from about 750° C. to about 850° C.

3. The method claimed in claim 1 wherein said second carburization is conducted for a period of about 1 to about 3 hours.

4. The method claimed in claim 3 wherein said initial carburization is conducted with a first gas having a carbon activity of greater than 1 for a first period of time, and subsequently with a second gas having a carbon activity less than 1 for a second period of time.

5. The method claimed in claim 1 wherein said precursor powders are formed by combining in solution a cobalt compound, a tungsten compound, and a precursor metal compound and spray drying said solution to form said precursor compound.

6. The product made by the process claimed in claim 1.

7. The product made by the process claimed in claim 2.

8. The product made by the process claimed in claim 3.

9. The product made by the process claimed in claim 4.

10. The product made by the process claimed in claim 5.

* * * * *